US009382906B2

(12) United States Patent
Flanigan

(10) Patent No.: US 9,382,906 B2
(45) Date of Patent: Jul. 5, 2016

(54) MULTI-STAGE RECIPROCATING COMPRESSOR

(75) Inventor: Paul J. Flanigan, Cicero, NY (US)

(73) Assignee: CARRIER CORPORATION, Farmington, CT (US)

( * ) Notice: Subject to any disclaimer, the term of this patent is extended or adjusted under 35 U.S.C. 154(b) by 238 days.

(21) Appl. No.: 13/063,601

(22) PCT Filed: Sep. 16, 2009

(86) PCT No.: PCT/US2009/057153

§ 371 (c)(1), (2), (4) Date: Mar. 11, 2011

(87) PCT Pub. No.: WO2010/033589

PCT Pub. Date: Mar. 25, 2010

(65) Prior Publication Data

US 2011/0171044 A1 Jul. 14, 2011

Related U.S. Application Data

(60) Provisional application No. 61/098,102, filed on Sep. 18, 2008.

(51) Int. Cl.
*F04B 53/16* (2006.01)
*F04B 53/10* (2006.01)

(52) U.S. Cl.
CPC ..... *F04B 53/16* (2013.01); *F04B 53/104* (2013.01); *F04B 53/162* (2013.01)

(58) Field of Classification Search
CPC ..... F04B 1/005; F04B 1/0465; F04B 1/53; F04B 1/16; F04B 1/162; F04B 1/104; F04B 27/1081; F04B 25/00; F04B 25/02; F04B 25/005
USPC ..... 417/244, 250, 251, 254, 521, 559, 255
See application file for complete search history.

(56) References Cited

U.S. PATENT DOCUMENTS 3,136,478 A * 6/1964 Soumerai ..... 417/62
3,472,446 A * 10/1969 Linnert ..... 417/539

(Continued)

FOREIGN PATENT DOCUMENTS

| | | | |
|---|---|---|---|
| CN | 2359485 | Y | 1/2000 |
| EP | 0845642 | A2 | 3/1998 |
| JP | 91959939 | B2 | 7/1997 |
| KR | 10-0190138 | B1 | 6/1999 |
| KR | 20-0430894 | | 11/2006 |

OTHER PUBLICATIONS

Notification of Transmittal of the International Search Report and the Written Opinion of the International Searching Authority, or the Declaration; PCT/US2009/057153; Mailed Apr. 22, 2010; Korean Intellectual Property Office.

Splice Technologies, Inc., "High Temperature Series Single Fiber Low Profile Fusion Splice Protection Sleeve"; http://www.splicetechnologies.com/HighTemperatureSeriesSingleFiber.php?id=FSS-SCH60; 2013.

(Continued)

*Primary Examiner* — Justin Jonaitis
*Assistant Examiner* — Charles Nichols
(74) *Attorney, Agent, or Firm* — Cantor Colburn LLP

(57) ABSTRACT

A multi-stage reciprocating compressor includes a cylinder block and a cylinder head. The cylinder block defines a low stage cylinder and a high stage cylinder. The cylinder head is secured to the cylinder block overlying the low and high stage cylinders. The cylinder head defines a mid-stage plenum which is in fluid communication with the low stage cylinder and the high stage cylinder for communicating a working fluid discharged from the low stage cylinder to the high stage cylinder.

15 Claims, 8 Drawing Sheets

(56) References Cited

U.S. PATENT DOCUMENTS

| | | | | |
|---|---|---|---|---|
| 3,876,339 | A * | 4/1975 | Gannaway | 417/312 |
| 5,078,580 | A * | 1/1992 | Miller et al. | 417/265 |
| 5,768,901 | A | 6/1998 | Dormer et al. | |
| 5,775,885 | A * | 7/1998 | Dreiman et al. | 417/553 |
| 6,488,480 | B1 * | 12/2002 | Zhong | 417/310 |
| 6,579,075 | B2 | 6/2003 | Lee et al. | |
| 6,827,561 | B2 | 12/2004 | Seo et al. | |
| 8,011,897 | B2 * | 9/2011 | Raleigh et al. | 417/271 |
| 2002/0085931 | A1 | 7/2002 | Lee et al. | |
| 2005/0201868 | A1 * | 9/2005 | Gao et al. | 417/254 |

OTHER PUBLICATIONS

Splice Technologies, Inc., "High Temperature Series Single Fiber Fusion Splice Protection Sleeve"; http://www.splicetechnologies.com/HighTemperatureSeriesSingleFiber.php?id=FSS-SCH40; 2013.

Extended European Search Report; Application No. EP09815115.2; Issued Apr. 8, 2015, 6 pages.

* cited by examiner

MULTI-STAGE RECIPROCATING COMPRESSOR

BACKGROUND

The present invention relates generally to reciprocating compressor assemblies, and more particularly, to multi-stage compressors that have two or more cylinders.

Compressors are used in many cooling, heating or refrigeration systems to compress a refrigerant fluid which circulates through the system. In the case of reciprocating compressors, a motor or engine turns a crankshaft which actuates reciprocation of one or more pistons inside one or more cylinders. Low pressure refrigerant enters the compressor through an inlet port in the compressor's casing and may be housed temporarily in a reservoir defined by the casing. The low pressure refrigerant from the reservoir is then drawn into the cylinders through a passageway(s) and compressed by the piston(s) to a higher temperature and pressure. The high pressure refrigerant gas discharged from the cylinder(s) leaves the reciprocating compressor through an outlet port in the cylinder head or casing and flows to the other components of the cooling, heating or refrigeration system.

In a multi-stage reciprocating compressor, the refrigerant fluid discharged from one or more low stage cylinders is drawn through another passageway(s) to one or more high stage cylinders. The refrigerant gas is further compressed by the piston(s) in the high stage cylinders. By dividing the reciprocating compressor into stages, it is possible to more efficiently compress the refrigerant to a higher pressure than can be accomplished with a single stage reciprocating compressor.

As is typical with components in many mechanical systems, it is desirable to keep the size and weight of the compressor(s) in the heating or cooling system to a minimum while engineering the unit to provide the system with as much capacity and efficiency as possible. The passageways between the stages in many conventional multi-stage reciprocating compressors require tubing or piping external to the compressor to communicate the refrigerant between the stages of the compressor. Unfortunately, the external tubing or piping can be a source of vibration and high and low frequency noise. The external piping also increases the size and overall weight of the compressor. The external piping also creates extra joints which have the potential to leak and adds additional parts which necessitate additional manufacturing steps including the fitting of piping to the compressor casing.

SUMMARY

A multi-stage reciprocating compressor includes a cylinder block and a cylinder head. The cylinder block defines a low stage cylinder and a high stage cylinder. The cylinder head is secured to the cylinder block overlying the low and high stage cylinders. The cylinder head defines a mid-stage plenum which is in fluid communication with the low stage cylinder and the high stage cylinder for communicating a working fluid discharged from the low stage cylinder to the high stage cylinder.

DETAILED DESCRIPTION

Overview of the Compressor 10

Figure 1:
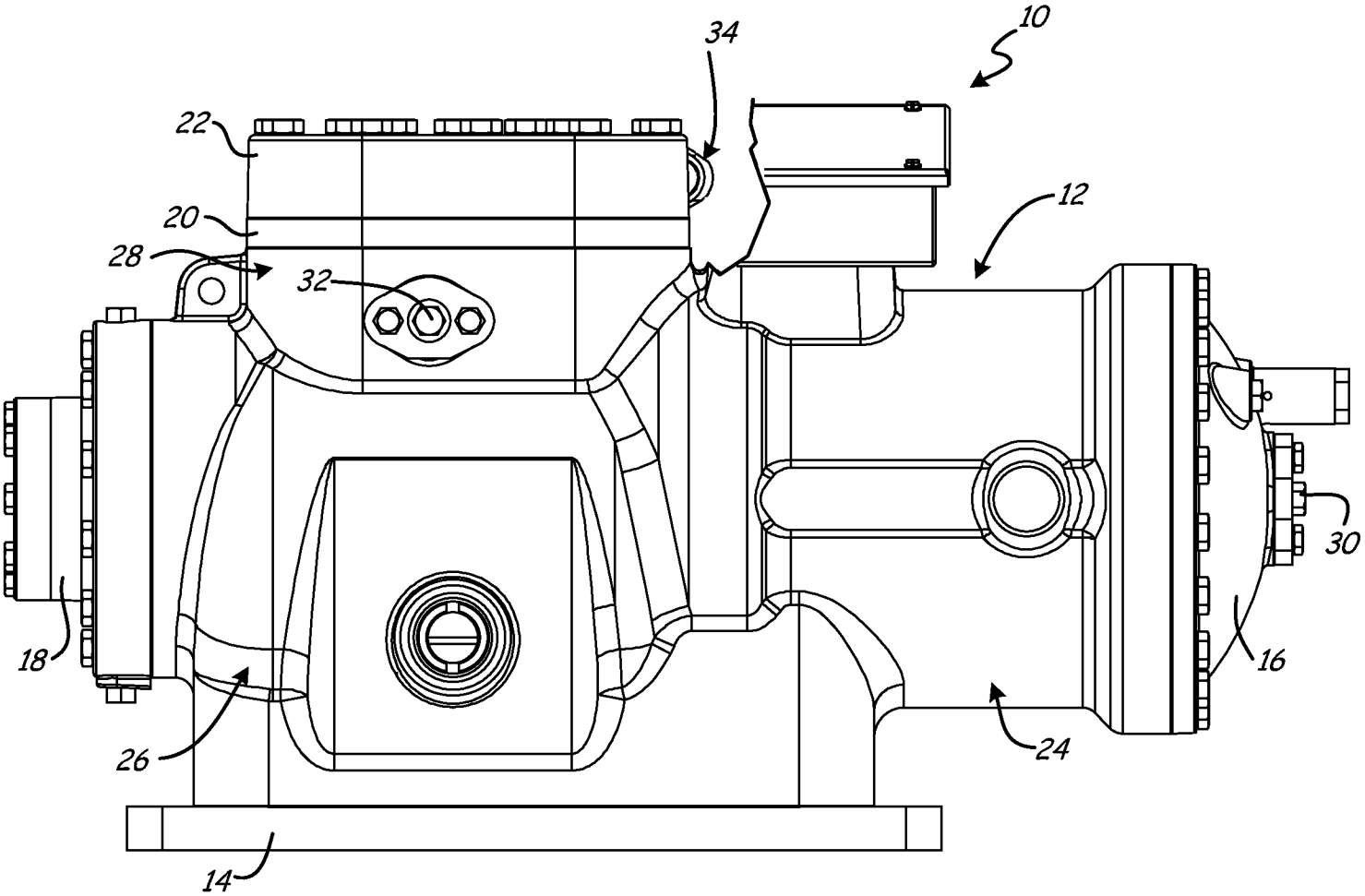
FIG. 1 is a side view of one embodiment of a multi-stage reciprocating compressor.

FIG. 1 shows a side view of one embodiment of a multi-stage reciprocating compressor 10. The reciprocating compressor 10 includes a casing 12, a mounting plate 14, a motor end cover 16, a bearing head assembly 18, a valve plate 20, and a cylinder head 22. The casing 12 includes a motor section 24, a crank case 26, and a cylinder block 28. The motor end cover 16 includes an inlet port 30. The cylinder block 28 includes a mid-stage port 32. The cylinder head 22 includes a high stage outlet port 34.

The compressor 10 includes the casing 12 which interconnects with the mounting plate 14. The casing 12 extends laterally from a first end, which receives the motor end cover 16, to a second end, which receives the bearing head assembly 18. The valve plate 20 and cylinder head 22 are secured to an upper portion of the casing 12. The motor section 24 of the casing 12 is overhung with respect to the mounting plate 14 and receives the motor end cover 16. The motor section 24 extends laterally over the mounting plate 14 to interconnect with the crank case 26 portion of the casing 12. The cylinder block 28 interconnects with the crank case 26 and interfaces with the valve plate 20. The inlet port 30, mid-stage port 32, and high stage outlet port 34 extend through the motor end cover 16, cylinder block 28, and cylinder head 22, respectively.

The mounting plate 14 and/or casing 12 is adapted to allow the compressor 10 to be bolted or otherwise affixed to a generally flat surface, such as a floor. The bearing head assembly 18 receives the crankshaft (which is disposed in the compressor 10) and provides service access to the internal components of the compressor 10. Together, the motor section 24 and the crank case 26 house and protect the majority of the interior components of the compressor 10.

A low pressure refrigerant enters the motor section 24 through the inlet port 30 in the motor end cover 16. The reciprocating movement of a piston(s) within the cylinder block 28 draws the refrigerant from the motor section 24 to the crank case 26. From the crank case 26 the refrigerant is drawn through an internal plenum and passageway system formed by the cylinder block 28, valve plate 20, and cylinder head 22 to low and high stage cylinders formed in the cylinder block 28. Valves (which interact with the valve plate 20) control the flow of refrigerant to or from the low and high stage cylinders. The reciprocating movement of the low and high stage pistons within the low and high stage cylinders compresses the refrigerant to a higher temperature and pressure in stages. In one embodiment, the refrigerant may be communicated through the mid-stage port 32 (after compression in the low stage cylinder(s)) to additional components of the heating or cooling system. These components may include, for example, additional compressors or heat exchangers. Generally, after leaving the low stage cylinder(s) the refrigerant is drawn into the high stage cylinder(s), where it is further compressed. After leaving the high stage cylinder(s) the high pressure refrigerant is discharged through the high stage outlet port 34 to the other components of the heating or cooling system.

Figure 1A:
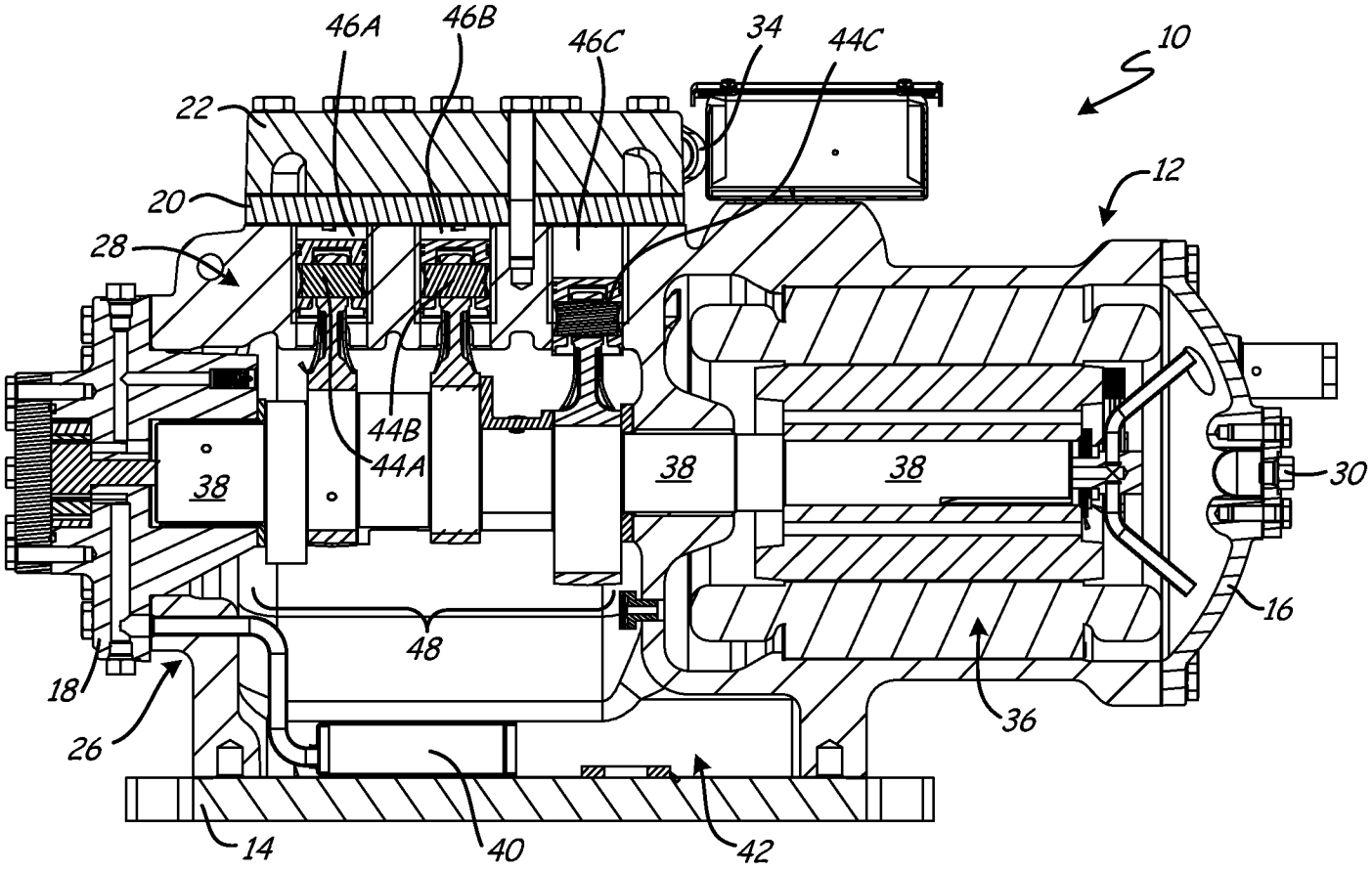
FIG. 1A is a side sectional view of the multi-stage reciprocating compressor from FIG. 1.

FIG. 1A shows a side sectional view of the multi-stage reciprocating compressor 10. In addition to the casing 12, the mounting plate 14, the motor end cover 16, the bearing head assembly 18, the valve plate 20, and the cylinder head 22, the compressor 10 includes: a motor 36, a crankshaft 38, an oil strainer or oil line 40, an oil sump 42, low stage pistons 44A and 44B, and a high stage piston 44C. The cylinder block 28 contains low stage cylinders 46A and 46B, and a high stage cylinder 46C. The crankshaft 38 includes an eccentric portion 48 to which the pistons 44A-44C are connected.

The overhung motor section 24 of the casing 12 receives the motor 36, which is disposed within the motor section 24. The motor 36 interconnects with and rotates the crankshaft 38 which is disposed laterally within the casing 12. The crankshaft 38 extends laterally from the motor 36 into the crank case 26 and is supported on bearings in the bearing head assembly 18. The motor end cover 16 secures to the motor section 24 of the casing 12 to enclose the motor 36 and crankshaft 38 within the compressor 10. The lower portion of the oil strainer or oil line 40 is disposed in the oil sump 42 and communicates with the bearing head assembly 18. The oil sump 42 is defined by a lower interior portion of the crank case 26 and a top interior portion of the mounting plate 14.

The pistons 44A, 44B, and 44C interconnect with and are reciprocatingly driven by the crankshaft 38. More specifically, the pistons 44A, 44B, and 44C interconnect axially along the eccentric portion 48 of the crankshaft 38 which is disposed in the crank case 26. The cylinder block 28 portion of the casing 12 is disposed to receive the head of the pistons 44A, 44B, and 44C within cylinders 46A, 46B, and 46C, respectively.

A portion of the oil strainer or oil line 40 communicates lubricating oil from the oil sump 42 through the bearing head assembly 18 to lubricate moving components such as the crankshaft 38. The oil sump 42 houses the excess lubricating oil used in the compressor 10. In one embodiment, the bearing head assembly 18 may be configured to house a positive displacement oil pump, which draws lubricating oil through the oil strainer 30 from the oil sump 42 and forces the oil through passageways or grooves in the crankshaft 38 and the pistons 44A, 44B, and 44C.

The portion of the crank case 26 around the crankshaft 38 defines a reservoir which temporarily houses the low pressure refrigerant drawn into the compressor 10 by the reciprocating action of the pistons 44A, 44B, and 44C in the cylinders 46A, 46B, and 46C. Before the low pressure refrigerant enters the reservoir, the refrigerant is first drawn through the inlet port 30 in the motor end cover 16. The disposition of the inlet port 30 in the motor end cover 16 adjacent to the motor 36 allows the lower pressure, lower temperature refrigerant entering the compressor 10 from the other components of the heating or cooling system to be drawn over and around the stator portion of the motor 36. In this configuration, the refrigerant provides additional cooling for the motor 36.

The cylinders 46A, 46B, and 46C extend through the cylinder block 28 and receive the heads of the pistons 44A, 44B, and 44C, respectively. In one embodiment, the cylinders 46A, 46B, and 46C are arrayed "in line" along an axis which is radially adjacent to and co-extensive with the axial length of the portion of the crankshaft 38. The casing 12, the valve plate 20, and the cylinder head 22 are configured such that the low pressure refrigerant in the reservoir is in fluid communication with the cylinders 46A, 46B, and 46C. Valving selectively contacts the valve plate 20 to regulate the flow of refrigerant into and out of the cylinders 46A, 46B, and 46C. Thus, during operation of the compressor 10, the low pressure refrigerant is selectively drawn into the cylinders 46A, 46B, and 46C from the reservoir and compressed to a higher pressure by the reciprocating movement of the pistons 44A, 44B, and 44C within the cylinders 46A, 46B, and 46C. The refrigerant is discharged from the cylinders 46A, 46B, and 46C after being compressed to a higher temperature and pressure.

To accomplish compression of the refrigerant the straps or connecting rods which comprise the inner radial portion of the pistons 44A, 44B, and 44C are configured with journal bearings which translate the rotation movement of the crankshaft 38 into linear movement of the pistons 44A, 44B, and 44C within the cylinders 46A, 46B, and 46C. In one embodiment, the portion of the crankshaft 38 which extends into the reservoir is configured as an eccentric 50A, 50B, and 50C with respect to the rotational axis of the crankshaft 38. The eccentric portion 48 allows the pistons 44A, 44B, and 44C to be linearly reciprocally moved for a predetermined distance within the cylinders 46A, 46B, and 46C. More specifically, the radial distance the eccentric portion 48 is offset from the axis of rotation of the crankshaft 38 determines the linear distance of the stroke of each piston 44A, 44B, and 44C. The piston 44A, 44B, and 44C stroke distance is one factor (along with multiple other factors, some of which include, for example, the number of pistons, the piston head diameter, motor horsepower, and the crankshaft rotational speed) in determining the capacity of the compressor 10 to draw and compress the refrigerant to a higher pressure.

The reciprocal motion of the pistons 44A, 44B, and 44C within the cylinders 46A, 46B, and 46C results in a piston "stroke cycle." The stroke cycle includes a suction or intake stroke, in which the refrigerant is drawn into the cylinder 46A, 46B, and 46C by the linear movement of the piston 44A, 44B, and 44C. The stroke cycle also includes a compression and discharge stroke, in which the refrigerant is compressed and discharged by the linear movement of the pistons 44A, 44B, and 44C within the cylinders 46A, 46B, and 46C.

In FIG. 1A, the configuration of the eccentric portion 48 allows each piston 44A, 44B, and 44C to be disposed at substantially 120 degrees of crankshaft rotation apart. The degree of crankshaft rotation each piston 44A, 44B, and 44C is disposed apart is determinative of the location each piston 44A, 44B, and 44C has at any particular moment in time. Similarly, the degree of crankshaft rotation each piston 44A, 44B, and 44C is disposed apart determines the linear direction of motion of each piston 44A, 44B, and 44C at any moment in time. In other embodiments of the multi-stage reciprocating compressor, for example a multi-stage reciprocating compressor with two cylinders and two pistons, the pistons may be disposed at degrees other than substantially 120 degrees of crankshaft rotation apart.

The cylinder block 28, the cylinder head 22, and the valve plate 20 define refrigerant flow passageways and plenums (the operation of which, along with the operation of the valving, will be discussed in greater detail subsequently in the specification) such that the pistons 44A, 44B, and 44C and cylinders 46A, 46B, and 46C may be characterized as low or high stages based upon the pressure of the refrigerant entering the cylinders 46A, 46B, and 46C before the compression stroke of the pistons 44A, 44B, and 44C. The heads of the low stage pistons 44A and 44B are disposed in the low stage cylinders 46A and 46B which are in fluid communication with the reservoir such that the low stage cylinders 46A and 46B receive the lower pressure refrigerant drawn from the reservoir. Similarly, the head of the high stage piston 44C is disposed in the high stage cylinder 46C which is in fluid communication with the low stage cylinders 46A and 46B such that the high stage cylinder 46C receives the higher pressure refrigerant discharged from the low stage cylinders 46A and 46B.

The low stage pistons 44A and 44B and the low stage cylinders 46A and 46B are disposed closer to the bearing head assembly 18 and extend radially outward from the crankshaft 38. The high stage piston 44C and high stage cylinder 46C are disposed adjacent the motor 36, and therefore, are shown as the right most piston in FIG. 1A. In other embodiments, the location of the high stage piston 44C and high stage cylinder 46C may differ with respect to the low stage piston(s) 44A and 44B and the low stage cylinder(s) 46A and 46B. In the multi-stage reciprocating compressor 10 shown in FIG. 1A, each piston 44A, 44B, and 44C has a substantially similar piston head diameter.

However, in other embodiments, for example a two cylinder/two piston multi-stage reciprocating compressor, the piston head diameter of the high stage piston may differ from the piston head diameter of the low stage piston.

The Components of the Crank Case 26

Figure 2:
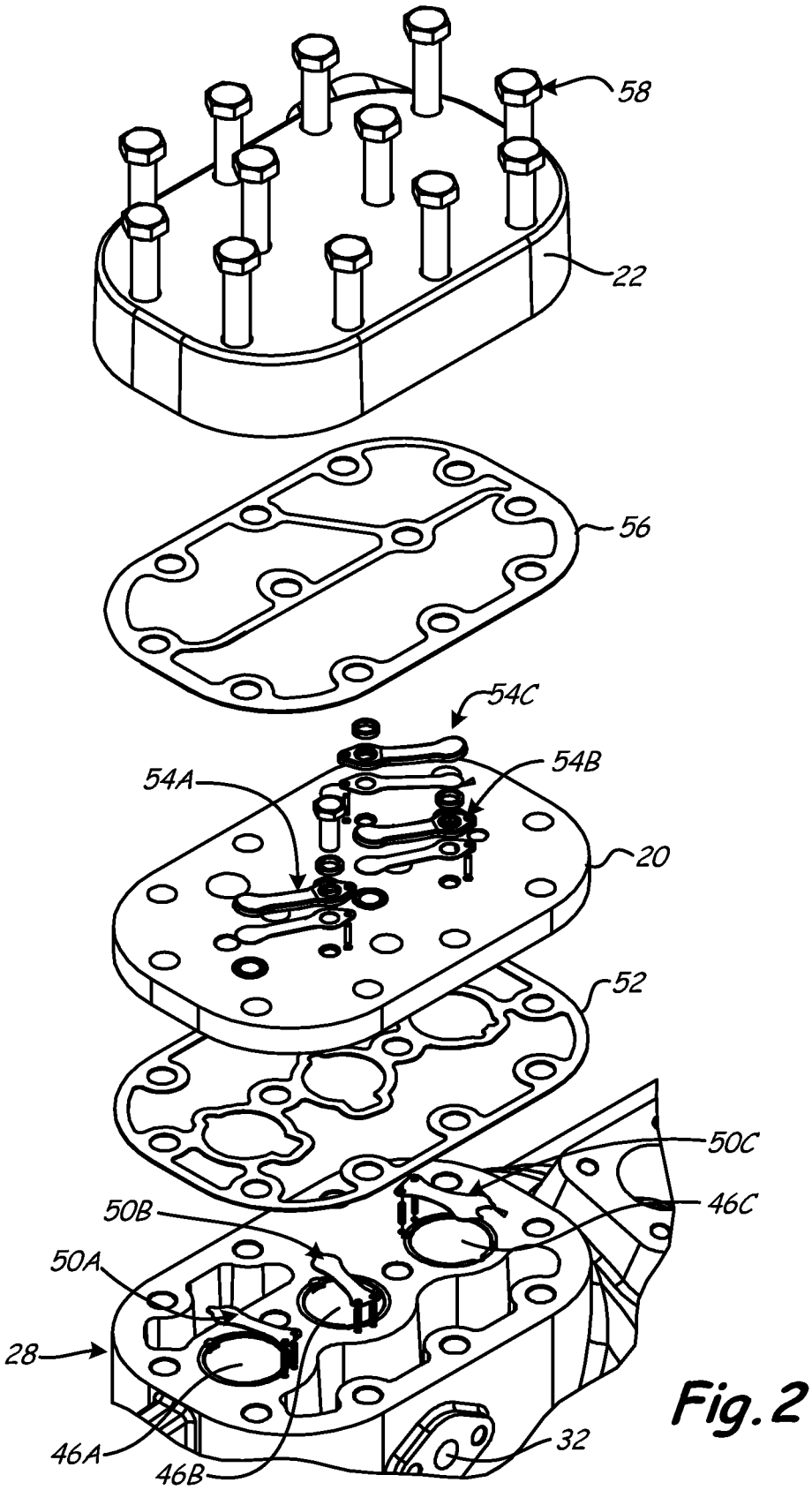
FIG. 2 is an exploded perspective view of a portion of the multi-stage reciprocating compressor shown in FIGS. 1 and 1A.

FIG. 2 is an exploded perspective view showing the components disposed above the cylinder block 28 of the compressor 10. In addition to the cylinder head 22, the valve plate 20, the cylinder block 28, and the cylinders 46A, 46B, and 46C, these components include: suction valve assemblies 50A, 50B, and 50C, a lower gasket 52, discharge valve assemblies 54A, 54B, and 54C, an upper gasket 56, and fasteners 58.

The cylinder block 28 defines the cylinders 46A, 46B, and 46C, which extend through a portion of the cylinder block 28. The upper axial end portion of each of the cylinders 46A, 46B, and 46C extends through the exterior surface of the cylinder block 28. The top surface of the cylinder block 28 receives the suction valve assemblies 50A, 50B, and 50C, which are illustrated as flexible reed valves in FIG. 2. When assembled and disposed in a "closed" position each suction valve assembly 50A, 50B, and 50C is disposed on the top surface of the cylinder block 28 and extends across one of the cylinders 46A, 46B, and 46C to selectively cover a lower portion of a refrigerant flow passageway(s) on the valve plate 20. The lower gasket 52 is disposed on top of the cylinder block 28 and adjacent to the suction valve assemblies 50A, 50B, and 50C when assembled. More specifically, the lower gasket 52 is configured with portions which are disposed above and radially around the upper portions the cylinders 46A, 46B, and 46C and the suction valve assemblies 50A, 50B, and 50C.

The valve plate 20 is disposed on the lower gasket 52 above the cylinder block 28 and interacts with the suction valve assemblies 50A, 50B, and 50C. The top surface of the valve plate 20 receives the discharge valve assemblies 54A, 54B, and 54C, which are mounted thereon. Similar to the suction valve assemblies 50A, 50B, and 50C, the discharge valve assemblies 54A, 54B, and 54C have flexible reed valve portions in one embodiment. When assembled, the upper gasket 56 is disposed on the upper surface of the valve plate 20, adjacent to the discharge valve assemblies 54A, 54B, and 54C. The upper gasket 56 is configured with portions which correspond to (and are contacted by) the base of the interior and exterior walls of the cylinder head 22. The cylinder head 22 is disposed on the lower gasket 52 above the cylinder block 28. The fasteners 58 secure the cylinder head 22, the upper gasket 56, the valve plate 20, and the lower gasket 52 to the cylinder block 28.

Ideally, the lower gasket 52 forms a hermetic barrier around the suction valve assemblies 50A, 50B, and 50C and above and around each cylinder 46A, 46B, and 46C such that the cylinders 46A, 46B, and 46C are in fluid communication only with portions of the valve plate 20 delineated by the lower gasket 52. Additionally, the lower gasket 52 ideally prevents refrigerant from leaking between the cylinder block 28 and the valve plate 20 to the atmosphere surrounding the compressor 10. Similarly, the upper gasket 56 ideally prevents refrigerant from leaking between the interior walls of the cylinder head 22 and the valve plate 20 or from between the valve plate 20 and the exterior walls of the cylinder head 22 to the atmosphere surrounding the compressor 10.

The valve plate 20 defines flow passageways or ports (the disposition and function of which will be discussed in greater detail subsequently in the specification) which provide for fluid communication of refrigerant between the plenums and the cylinders 46A, 46B, and 46C. Each suction valve assembly 50A, 50B, and 50C and discharge valve assembly 54A, 54B, and 54C is configured to selectively inhibit or impinge the flow of refrigerant through one or more of the flow passageways in the valve plate 20 during a portion of the stroke cycle of the piston 44A, 44B, and 44C. The cylinder head 22 defines the upper portions of the plenums (the disposition and function of which will be described in conjunction with FIGS. 3 and 4) which temporarily receive refrigerant from the passageways in the valve plate 20. If the compressor 10 uses a "bank" formation, (also referred to as a "V formation" where the cylinders 46A, 46B, and 46C and pistons 44A, 44B, and 44C (FIG. 1A) are aligned along two separate planes) multiple cylinder heads 24 may be used to cover the multiple banks of cylinder block 40.

Figure 3:
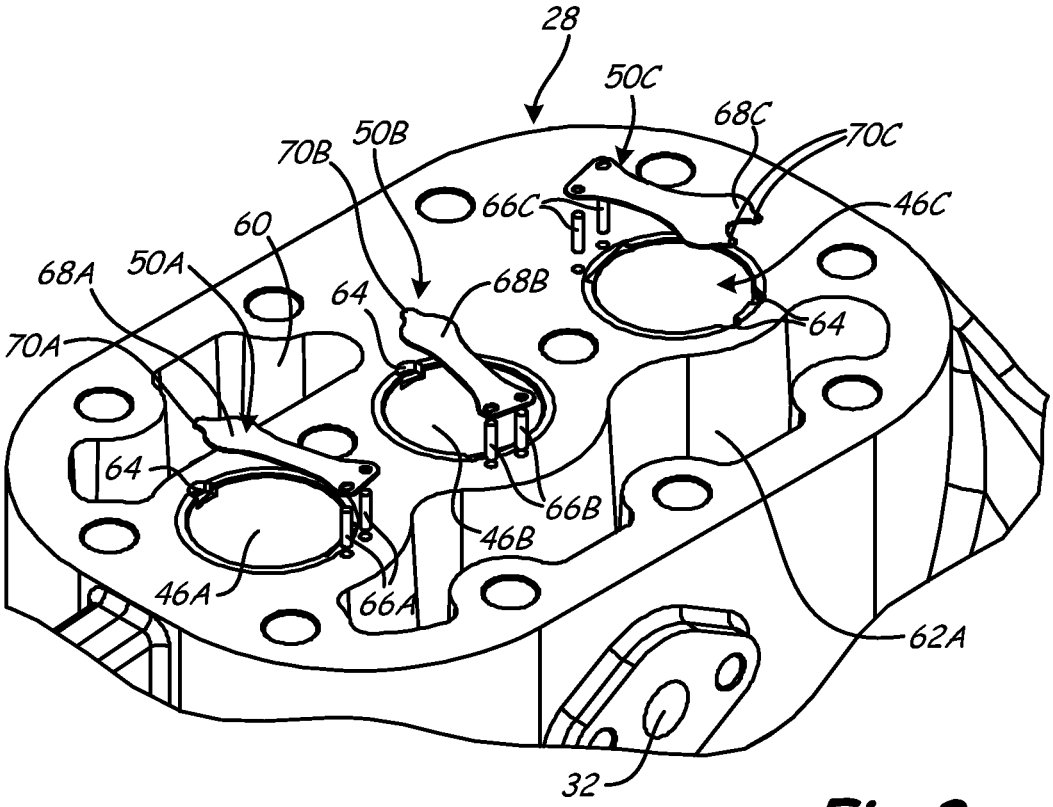
FIG. 3 is a perspective view of a cylinder block and suction valves shown in FIG. 2.

The Cylinder Block 28 and Suction Valve Assemblies 50A, 50B, and 50C FIG. 3 is a perspective view showing the top portion of the cylinder block 28 and the suction valve assemblies 50A, 50B, and 50C. The cylinder block 28 defines a low stage plenum 60, a lower portion of a mid-stage plenum 62A, and stop recesses 64. The suction valve assemblies 50A, 50B, and 50C include pins 66A, 66B, and 66C and flexible members 68A, 68B, and 68C. The flexible members 68A, 68B, and 68C include tips 70A, 70B, and 70C.

The cylinder block 28 projects from the upper portion of the piston section 16 of the compressor 10. In one embodiment, the cylinder block 28 has a generally flat top surface. Besides defining the cylinders 46A, 46B, and 46C, the cylinder block 28 also defines the lower portions of the low stage plenum 60 and the mid-stage plenum 62A.

The low stage plenum 60 extends through the cylinder block 28 and is in fluid communication with the reservoir. The lower portion of the mid-stage plenum 62A extends into the cylinder block 28 but terminates at a predetermined depth such that the lower portion of the mid-stage plenum 62A is a chamber surrounded by the cylinder block 28. The lower portion of the mid-stage plenum 62A is in fluid communication with an upper portion of the mid-stage plenum defined by the cylinder head 22 (FIG. 2).

The cylinder block 28 is configured with apertures adjacent each of the cylinders 46A, 46B, and 46C which receive the pins 66A, 66B, and 66C. The pins 66A, 66B, and 66C secure the flexible member 68A, 68B, and 68C portion of the suction valve assemblies 50A, 50B, and 50C to the cylinder block 28. When assembled the flexible members 68A, 68B, and 68C are cantilevered from the base portion receiving the pins 66A, 66B, and 66C over the axial end portion of each cylinder 46A, 46B, and 46C. In the closed position, each of the flexible members 68A, 68B, and 68C extends over the axial end portion of one of the cylinders 46A, 46B, and 46C to contact and ideally cover a suction flow passageway(s) or ports which extend through the valve plate 20. The lip of each of the cylinders 46A, 46B, and 46C is configured with one or two stop recesses 64 disposed generally diametrically from the apertures which receive the pins 66A, 66B, and 66C. Only when the suction valve assembly 50A, 50B, and 50C is in an opened position do the tips 70A, 70B, and 70C of each of the flexible members 68A, 68B, and 68C engage the stop recesses 64 in the cylinder block 28.

During operation of the compressor 10, the refrigerant is drawn from the reservoir into the low stage plenum 60 by the suction stroke of the low stage pistons 44A and 44B within the low stage cylinders 46A and 46B. The low stage plenum 60 is also in selective fluid communication with the low stage cylinders 46A and 46B through the valve plate 20, which allows refrigerant from the low stage plenum 60 to enter the low stage cylinders 46A and 46B.

Similarly, the lower portion mid-stage plenum 62A is in selective fluid communication with the low stage cylinders 46A and 46B through the valve plate 20. The refrigerant discharged from the low stage cylinders 46A and 46B during the compression and discharge stroke of the low stage pistons 44A and 44B enters the upper portion and lower portion of the mid-stage plenum 62A. The lower portion of the mid-stage plenum 62A is also in selective fluid communication with the high stage cylinder 46C through the valve plate 20. This allows the refrigerant from the lower portion of the mid-stage stage plenum 62A to be drawn into the high stage cylinder 46C through the upper portion of the mid-stage plenum during the suction stroke of the high stage piston 44C. In one embodiment, the mid-stage port 32 is disposed in fluid communication with the upper portion of the mid-stage plenum 62B. The mid-stage port 32 allows refrigerant compressed by the low stage pistons 44A and 44B to be communicated to or from additional components of the heating or cooling system. These components may include, for example, additional compressors or heat exchangers.

As previously indicated, in one embodiment the flexible members 68A, 68B, and 68C are reed valves and are comprised of a thin leaf spring material, which allows the members 68A, 68B, and 68C to flex or deform into and out of the top portion of the cylinders 46A, 46B, and 46C when assembled during operation. The base portion of the flexible members 68A, 68B, and 68C receives the pins 66A, 66B, and 66C which secure the flexible members 68A, 68B, and 68C in a location above each of the cylinders 46A, 46B, and 46C. The pins 66A, 66B, and 66C ideally prevent the flexible members 68A, 68B, and 68C from unseating or moving from side to side during the stroke cycle of the pistons 36. As reed valves, the flexible members 68A, 68B, and 68C operate by moving from the normally closed position (described above) to an "open" position by flexing open due to a pressure differential generated across the valve in the direction of opening. Thus, in the case of the suction valve assemblies 50A, 50B, and 50C, the suction stroke of the pistons 36 in the cylinders 46A, 46B, and 46C creates the pressure differential across the flexible members 68A, 68B, and 68C, which causes the flexible members 68A, 68B, and 68C to open by temporarily flexing or deforming into the top portion of the cylinders 46A, 46B, and 46C.

When the suction valve assemblies 50A, 50B, and 50C open (and because the pistons 36 are substantially 120 degrees of crankshaft rotation apart, the opening of each suction valve assembly 50A, 50B, and 50C will not occur simultaneously), the tips 70A, 70B, and 70C of the flexible member 68A, 68B, and 68C engage the stop recesses 64 in the cylinder block 28 after a small amount of opening movement. Further valve 50A, 50B, and 50C opening into each of the cylinders 46A, 46B, and 46C then occurs during the remainder of the suction stroke due to flexure or bowing of the flexible member 68A, 68B, and 68C between the tips 70A, 70B, and 70C and the pins 66A, 66B, and 66C. After completion of the suction stroke and during the discharge and compression stroke of the pistons 36, the flexible members 68A, 68B, and 68C return to the generally unbowed closed position contacting and ideally covering the suction flow passageways which extend through the valve plate 20.

The Cylinder Head 22

Figure 4:
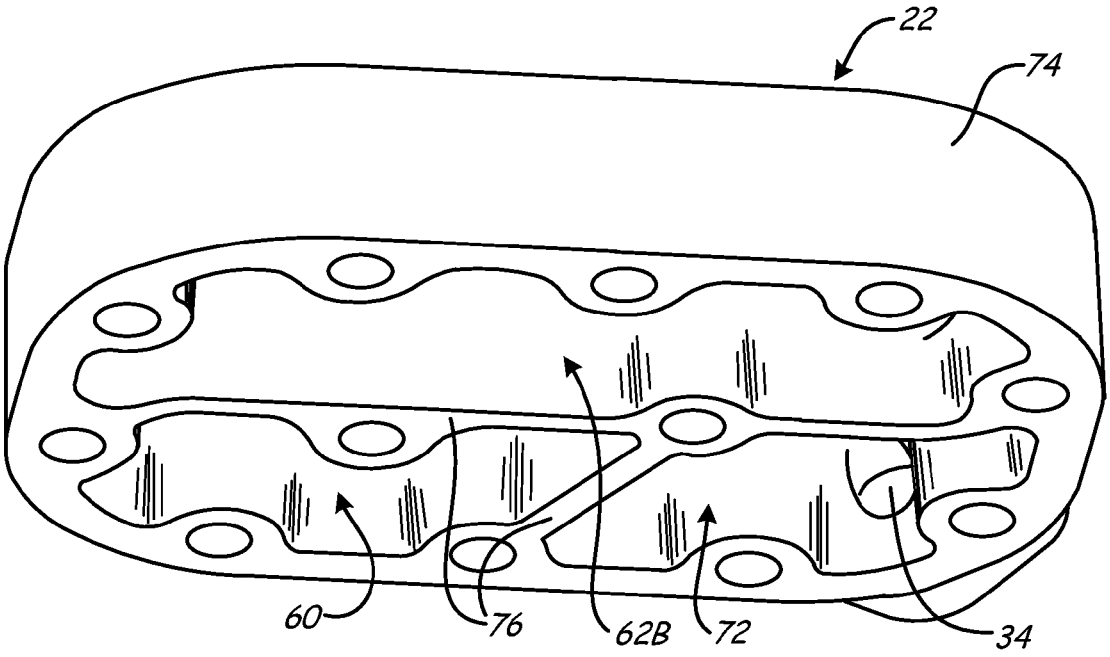
FIG. 4 is a perspective view of the cylinder head shown in FIG. 2 illustrating a low stage plenum, a mid-stage plenum, and a high stage plenum with a discharge port.

FIG. 4 is a bottom perspective view of one embodiment of the cylinder head 22. In addition to the low stage plenum 60 and the upper portion of the mid-stage plenum 62B, the cylinder head 22 defines a high stage plenum 72. More specifically, the exterior walls 74 and interior walls 76 of the cylinder head 22 define the upper portions of the plenums 60, 62B, and 72.

The view of the cylinder head 22 shown in FIG. 4 illustrates the upper portions of the low stage, mid-stage, and high stage plenums 60, 62B, and 72 defined by the cylinder head 22. The plenums 60, 62B, and 72 may also be defined by the valve plate 20 and the cylinder block 28. More specifically, the exterior walls 74 define the top portions of the plenums 60, 62B, and 72 and form a hermetic barrier between the compressed refrigerant and the atmosphere. The interior walls 76 also hermetically separate and define the plenums 60, 62B, and 72. Each plenum 60, 62B, or 72 houses refrigerant which has a temperature and pressure which differs from the temperature and pressure of the refrigerant housed in each of the other plenums 60, 62B, or 72. The high stage outlet port 34 in the cylinder head 22 allows the refrigerant to pass from the high stage plenum 72 through the cylinder head 22 to the other components in the heating or cooling system. Holes are defined by the exterior walls 74 and interior walls 76 and extend generally vertically through these features. The holes receive the fasteners 58 (FIG. 2) which secure the cylinder head 22, the upper gasket 56, the valve plate 20, and the lower gasket 52 to the cylinder block 28 (FIG. 2).

Figure 5A:
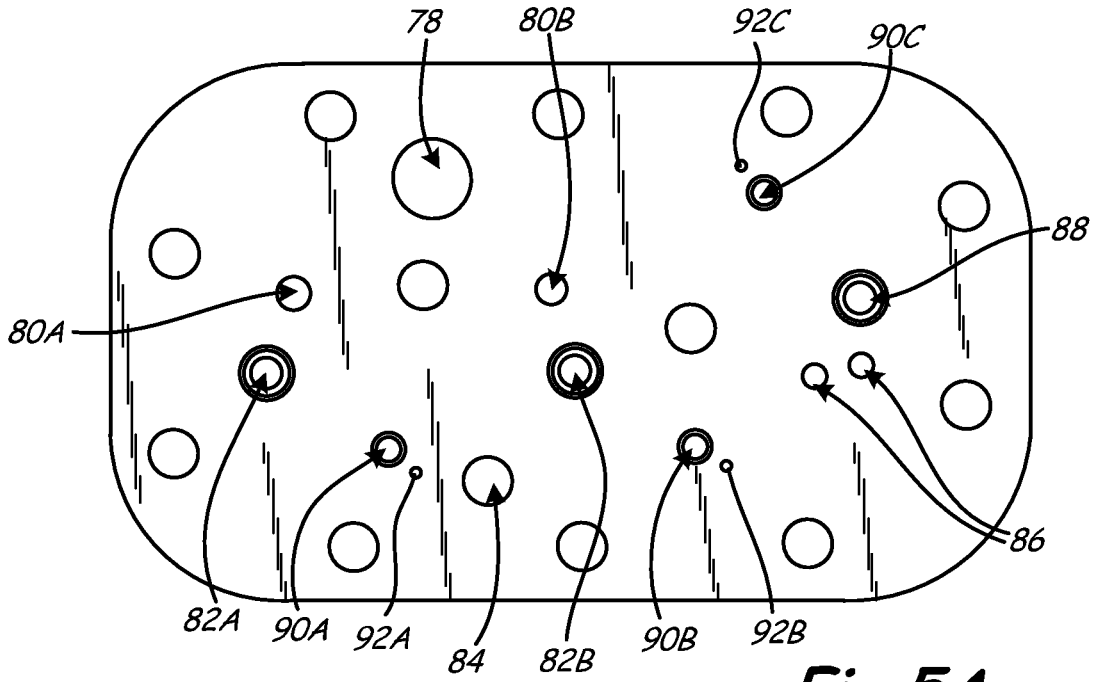
FIG. 5A is top view of a valve plate from FIG. 2 showing a plurality of passageways through the valve plate.

The Valve Plate 20 and Discharge Valve Assemblies 54A, 54B, and 54C FIG. 5A is a top view of one embodiment of the valve plate 20 with the discharge valve assemblies 54A, 54B, and 54C removed. The valve plate 20 defines a low stage plenum passageway 78, low stage suction ports 80A and 80B, low stage discharge ports 82A and 82B, a mid-stage plenum passageway 84, high stage suction ports 86, a high stage discharge port 88, valve apertures 90A, 90B, and 90C, and pin holes 92A, 92B, and 92C.

The valve plate 20 defines a plurality of passageways which extend through the valve plate 20 to allow for fluid communication of the refrigerant between the plenums 60, 62B, and 72 and the cylinders 46A, 46B, and 46C (FIG. 2). More specifically, the generally cylindrical low stage plenum passageway 78, which is illustrated as the top left cylindrical passageway in FIG. 5A extends through the valve plate 20. The low stage suction ports 80A and 80B also extend through the valve plate 20 adjacent to the low stage plenum passageway 78. Each of the low stage suction ports 80A and 80B terminates immediately adjacent to and above each of the low stage cylinders 46A and 46B.

Adjacent to the low stage suction ports 80A and 80B, the low stage discharge ports 82A and 82B extend through the valve plate 20 and are disposed such that at least one of the low stage discharge ports 82A and 82B terminates immediately adjacent to and above one of the low stage cylinders 46A and 46B when the valve plate 20 is assembled on the cylinder block 28. The mid-stage plenum passageway 84 extends through the valve plate 20 adjacent to the low stage discharge ports 82A and 82B and provides a means for communication between the upper portion of the mid-stage plenum 62B and lower portion of the mid-stage plenum 62A. The high stage suction ports 86 also extend through the valve plate 20 and are disposed in communication with the mid-stage plenum 62B when the cylinder head 22 is assembled on the valve plate 20. In one embodiment, the high stage suction ports 86 and the low stage discharge ports 82A and 82B are disposed on the same side of an axis of symmetry of the valve plate 20.

The high stage discharge port 88 also extends through the valve plate 20. The valve plate 20 is configured such that the high stage discharge port 88 terminates immediately adjacent to and above the high stage cylinder 46C when the valve plate 20 is assembled on the cylinder block 28. The valve plate 20 also defines the valve apertures 90A, 90B, and 90C and the pin holes 92A, 92B, and 92C which are adapted to receive the pins and screws which secure the suction valve assemblies 54A, 54B, and 54C atop the valve plate 20. In one embodiment, the high stage discharge port 88 and the low stage suction ports 80A and 80B are disposed on the same side of an axis of symmetry of the valve plate 20.

When the cylinder head 22 is assembled on the valve plate 20, the low stage plenum passageway 78 allows the refrigerant to flow between the lower portion of the low stage plenum 60 defined by the cylinder block 28 and the upper portion of the low stage plenum 60 defined by the cylinder head 22. Likewise, the low stage suction ports 80A and 80B allow for the fluid communication of the refrigerant from the low stage plenum 60 to the low stage cylinders 46A and 46B. The refrigerant flows from the low stage cylinders 46A and 46B to the upper portion of the mid-stage plenum 62B through the low stage discharge passageways 82A and 82B.

In one embodiment, the upper surface of the valve plate 20 radially exterior to and adjacent each of the low stage discharge ports 82A and 82B and the high stage discharge port 88 is milled or otherwise machined to form a circular channel. The upper surface of the valve plate 20 between the circular channel and each of the discharge passageways 82A and 82B, 88 forms a seat upon which the discharge valve assemblies 54A, 54B, and 54C rest when in a "closed" flow impinging position. The circular channel reduces the adherence of the suction valve assemblies 54A, 54B, and 54C to the valve plate 20 due to an oil film residue. This allows the suction valve assemblies 54A, 54B, and 54C to be more effectively opened during the compression and discharge stroke of the pistons 36.

Refrigerant flows between the lower portion of the mid-stage plenum 62A defined by the cylinder block 28 and the upper portion of the mid-stage plenum 62B defined by the cylinder head 22 through the mid-stage plenum passageway 84. Similarly, the high stage suction ports 86 allow the refrigerant to flow from the upper portion of the mid-stage plenum 62B to the high stage cylinder 46C and the high stage discharge port 88 allows the refrigerant to flow from the high stage cylinder 46C to the high stage plenum 72.

Figure 5B:
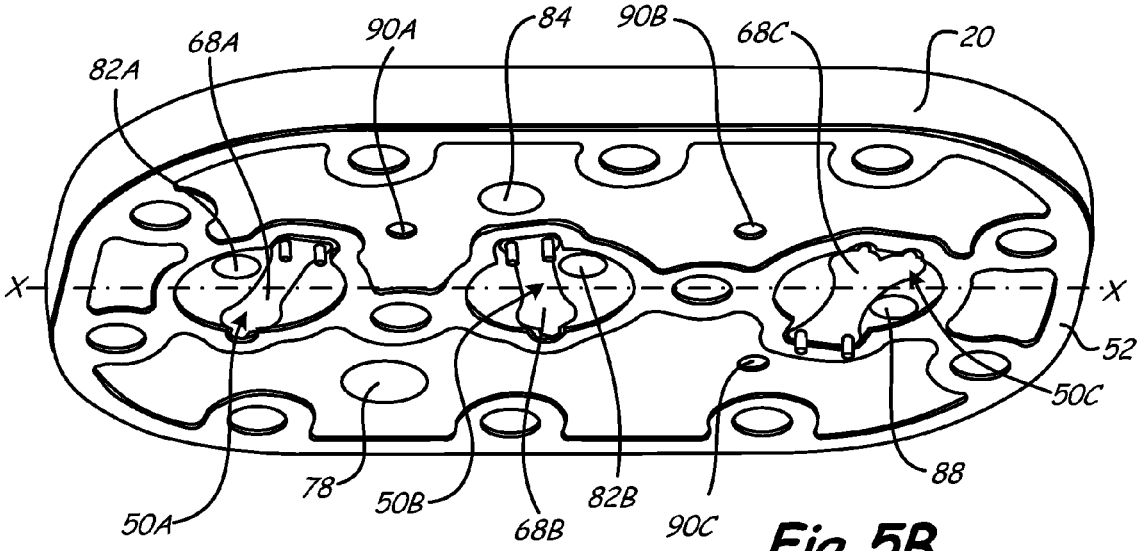
FIG. 5B is a bottom perspective view of the valve plate of FIG. 5A with a bottom gasket assembled on the valve plate and the suction valves disposed immediately below and contacting a lower portion of the valve plate.

FIG. 5B is a bottom perspective view of one embodiment of the valve plate 20 with the cylinder block 28 suppressed so that the assembled arrangement of the suction valve assemblies 50A, 50B, and 50C and lower gasket 52 are illustrated. Because the lower gasket 52 is configured with central portions which are disposed above and radially around the upper portions the cylinders 46A, 46B, and 46C (FIG. 2) and the suction valve assemblies 50A, 50B, and 50C, the viewer of FIG. 5B will appreciate that the disposition of the cylinders 46A, 46B, and 46C are delineated by the central portions of the lower gasket 52. Thus, the disposition of the lower gasket 52 on the valve plate 20 correlates to the disposition of the cylinders 46A, 46B, and 46C below the valve plate 20 when the valve plate 20 is assembled on the cylinder block 28. The disposition of the suction valve assemblies 50A, 50B, and 50C and the low and high stage discharge ports 82A and 82B, 88 with respect to the lower gasket 52 correlates to the disposition of those features with respect to the cylinders 46A, 46B, and 46C when the valve plate 20 is assembled on the cylinder block 28. Axis X-X extends generally along an axis of symmetry of the valve plate 20 and would extend through the center of each of the cylinders 46A, 46B, and 46C when the valve plate 20 is assembled on the cylinder block 28.

In one embodiment, the low stage discharge ports 82A and 82B and the high stage suction ports 86 (FIG. 5A) are generally aligned and disposed on the same side of the X-X axis. Similarly, the low stage suction ports 80A and 80B (FIG. 5A) and the high stage discharge port 88 are generally aligned and disposed on the same side of side of the X-X axis. The low stage discharge ports 82A and 82B and the high stage discharge port 88 have a mirror symmetry with respect to the X-X axis such that the low stage discharge ports 82A and 82B are disposed on one side of the X-X axis and the high stage discharge port 88 is disposed on the other side of the X-X axis.

In FIG. 5B, the suction valve assemblies 50A, 50B, and 50C are all illustrated in the closed position with each of the flexible members 68A, 68B, and 68C contacting and covering the suction flow ports 80A and 80B, 86 (FIG. 5A). In the open position, the pressure differential across the flexible members 68A, 68B, and 68C would cause the flexible members 68A, 68B, and 68C to bow or deform downwards such that the flexible members 68A, 68B, and 68C no longer cover or contact the suction flow ports 80A and 80B, 86. The low and high stage discharge flow passageways 82A and 82B, 88 extend through the valve plate 20 adjacent the suction valve assemblies 50A, 50B, and 50C. When the valve plate 20 and lower gasket 52 are assembled on the cylinder block 28, each low and high stage discharge flow passageway 82A and 82B, 88 is disposed immediately above one of the cylinders 46A, 46B, and 46C within the radial space defined by the lower gasket 52. This allows the low and high stage discharge flow passageways 82A and 82B, 88 to be in fluid communication with the cylinders 46A, 46B, and 46C.

Figure 5C:
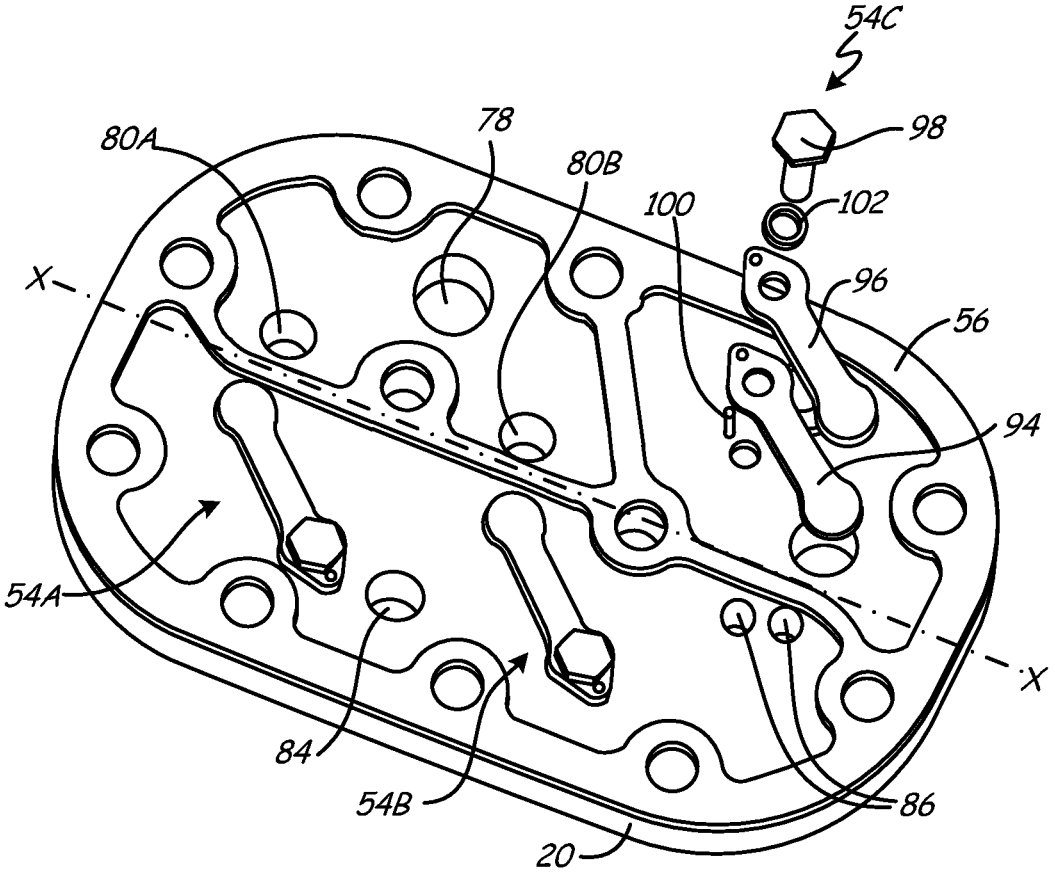
FIG. 5C is a top perspective view of the valve plate of FIG. 5A with a top gasket and several discharge valves assembled on the valve plate.

FIG. 5C shows a top perspective view of one embodiment of the valve plate 20 with the cylinder block 28 suppressed and the cylinder head 22 removed so that the assembled arrangement of the discharge valve assemblies 54A, 54B, and 54C and upper gasket 56 are illustrated. Because the upper gasket 56 rests below the interior and exterior walls 74, 76 (FIG. 4) of the cylinder head 22 when the cylinder head 22 is assembled on the valve plate 20, the viewer of FIG. 5C will appreciate that the disposition of the interior and exterior walls 74, 76 which define the plenums 60, 62B, and 72 are delineated by the upper gasket 56. Thus, the disposition of the upper gasket 56 on the valve plate 20 correlates to the disposition of the plenums 60, 62B, and 72 above the valve plate 20 when the cylinder head 22 is assembled on the valve plate 20. The disposition of the discharge valve assemblies 54A, 54B, and 54C and the low and the high stage suction ports 80A and 80B, 86 with respect to the upper gasket 56 correlates to the disposition of those features with respect to the plenums 60, 62B, and 72 when the cylinder head 22 is assembled on the valve plate 20. Axis X-X extends generally along an axis of symmetry of the valve plate 20.

In one embodiment, the low stage discharge ports 82A and 82B (FIG. 5B) and the high stage suction ports 86 are generally aligned and disposed on the same side of the X-X axis. Similarly, the low stage suction ports 80A and 80B and the high stage discharge port 88 (FIG. 5B) are generally aligned and disposed on the same side of side of the X-X axis.

In FIG. 5C, two of the discharge valve assemblies 54A and 54B are all illustrated in the closed position with portions of the valves 54A and 54B contacting and covering the discharge flow passageways 82A and 82B, 88 (FIG. 5A). One discharge valve assembly 54C is shown exploded to better illustrate the components of the discharge valve assembly 54A, 54B, and 54C. These components include a flapper component 94, a backer 96, screws 98, pins 100, and lock washers 102. Discharge valve assemblies 54A and 54B include similar components as discharge valve assembly 54C.

Discharge valve assemblies 54A and 54B (which are located above the low stage cylinders 46A and 46B and adjacent the low stage suction flow ports 80A and 80B) are disposed in the mid-stage plenum 62B when the cylinder head 22 and valve plate 20 are assembled on the cylinder block 28 (FIG. 2). Discharge valve assembly 54C is disposed above the high stage cylinder 46C in the high stage plenum 72 when the cylinder head 22 and valve plate 20 are assembled on the cylinder block 28.

Similar to the suction valve assemblies 50A, 50B, and 50C, the discharge valve assemblies 54A, 54B, and 54C include the flapper component 94 which operates as a reed valve. The flapper component 94 of the discharge valve assemblies 54A, 54B, and 54C is comprised of a thin leaf spring material, which allows the flapper component 94 to flex or deform away from the closed position covering the discharge flow passageways 82A and 82B, 88. Unlike the suction valve assemblies 50A, 50B, and 50C, the discharge valve assemblies 54A, 54B, and 54C include a backer 96 which limits the movement of flapper component 94 and are adapted to dissipate the opening force applied to flapper component 94 by refrigerant discharging from the discharge flow passageways 82A and 82B, 88. Each backer 96 is rigidly configured to provide enough space for the refrigerant to discharge from underneath the backer 96 and flapper component 94 when the flapper component 94 moves to an "open" position away from the valve plate 20. The flapper component 94 and backer 96 are secured to the valve plate 20 by the screws 98, pins 100 and lock washers 102. The base portion of each flapper component 94 and each backer 96 are adapted to receive one of the screws 98, which extends through those components and the lock washers 102 to be received in one of the valve apertures 90A, 90B, and 90C defined by the valve plate 20. Similarly, the base portion of the flapper component 94 and the backer 96 are adapted to receive one of the pins 100, which extends through those components and is received in one of the pin holes 92A, 92B, and 92C defined by the valve plate 20.

The Operation of the Compressor 10

During operation of the compressor 10, low pressure refrigerant is drawn from the reservoir into the lower portion of the low stage plenum 60 defined by the cylinder block 28 shown in FIG. 2. From the lower portion of the low stage plenum 60 the refrigerant is further drawn through the low stage plenum passageway 78 (FIGS. 5A to 5C) to the upper portion of the low stage plenum 60 by the suction stroke of each of the low stage pistons 44A and 44B. The suction stroke of each of the low stage pistons 44A and 44B also draws the refrigerant through the low stage suction ports 80A and 80B into each of the low stage cylinders 46A and 46B.

Because the low stage pistons 44A and 44B are disposed at substantially 120 degrees of crankshaft rotation apart, the onset of the suction stroke will occur at a different moment in time for each low stage piston 44A and 44B. Likewise, the suction stroke will terminate at a different moment in time for each low stage piston 44A and 44B. The suction valve assemblies 50A and 50B above the low stage cylinders 46A and 46B will temporarily flex or bow to open and allow the refrigerant to enter the low stage cylinders 46A and 46B through the low stage suction ports 80A and 80B. The temporary flexing or bowing of each suction valve assembly 50A and 50B occurs at a different moment in time due to the pressure differential created by the suction stroke of each low stage piston 44A and 44B within each low stage cylinder 46A and 46B. Because the two low stage pistons 44A and 44B are substantially 120 degrees of crankshaft rotation apart, the suction valve assemblies 50A and 50B above the low stage cylinders 46A and 46B will be open simultaneously together for about 60 degrees of crankshaft rotation before one of the suction valve assemblies 50A, 50B, and 50C closes. Suction valve assemblies 50A and 50B return to the closed position covering and impinging refrigerant flow through each low stage suction port 80A and 80B at a different moment in time. The two suction valve assemblies 50A and 50B will be closed simultaneously together for about 60 degrees of crankshaft rotation before one suction valve assembly opens.

Onset of the compression and discharge stoke for each low stage piston 44A and 44B occurs when that piston begins outward radial linear movement (with respect to the crankshaft 38). During the compression and discharge stroke of each low stage piston 44A and 44B, the refrigerant received in the low stage cylinders 46A and 46B during their suction strokes is compressed to a higher temperature and pressure. The suction valve assemblies 50A and 50B above the low stage cylinders 46A and 46B return to the closed position covering each low stage suction port 80A and 80B during compression and discharge strokes. The refrigerant, now compressed to a higher temperature and pressure, begins to discharge from each low stage cylinder 46A and 46B through each of the corresponding low stage discharge ports 82A and 82B at a different moment in time.

More specifically, the pressure differential across the flapper component 94A and 94B (caused by the compression of the refrigerant by the low stage pistons 44A and 44B) of each of the discharge valve assemblies 54A and 54B becomes sufficient to open the flapper component 94A and 94B to allow for refrigerant passage at different moment in time for each discharge valve assembly 54A and 54B. Similar to each of the suction valve assemblies 50A and 50B, the discharge valve assemblies 54A and 54B will be open simultaneously together for about 60 degrees of crankshaft rotation before one discharge valve assembly closes.

Simultaneous with the opening of the discharge valve assemblies 54A and 54B, the refrigerant (which had been impinged in the low stage discharge passageway 82A and 82B by the discharge valve assembly 54A, 54B, and 54C) is discharged into the upper portion mid-stage plenum 62B defined by the valve plate 20 and the interior and exterior walls 74, 76 of the cylinder head 22. During the temporary residence of the refrigerant in the mid-stage plenum 62A and 62B, the refrigerant may pass through the mid-stage plenum passageway 84 into the lower portion of the mid-stage plenum 62B defined by the valve plate 20 and the cylinder block 28.

The refrigerant fluid temporarily housed in the mid-stage plenum 62A and 62B is then drawn through the high stage suction ports 86 into the high stage cylinder 46C by the suction stroke of the high stage piston 44C.

By disposing the low stage discharge ports 82A and 82B in communication through the same portion of the valve plate 20 which defines the mid-stage plenum 62B as the high stage suction ports 86, external piping between the ports 82A and 82B and 86 and a conventional separate low stage discharge plenum and a high stage suction plenum are avoided. Likewise, the configuration of the discharge and suction ports defined by the valve plate 20 and the plenums in the cylinder head 22 allows the discharge valve assemblies 54A and 54B above the low stage cylinders 46A and 46B to be disposed solely within the mid-stage plenum 62B.

The disposition of the low stage discharge ports 82A and 82B, the high stage suction ports 86, and the valving allows the refrigerant to selectively flow from the low stage cylinders 46A and 46B to the high stage cylinder 46C without the use of piping external to the cylinder head 22 or casing 12. The elimination of external tubing or piping reduces a potential source of compressor 10 vibrations. A reduction in compressor 10 vibrations reduces the high and low frequency noise associated with refrigeration flow in the external piping. The elimination of external piping also reduces the size and overall weight of the compressor 10, and reduces the number of compressor 10 parts. The reduction in compressor parts 10 reduces the number steps required for manufacture and assembly of the compressor 10.

Because the high stage piston 44C is disposed at substantially 120 degrees of crankshaft rotation apart from the central low stage piston 44B, the onset of the suction stroke will occur at a different moment in time for the high stage piston 44C and the central low stage piston 44B. Similarly, the suction stroke will terminate at a different moment in time for the high stage piston 44C and the central low stage pistons 44A and 44B. The suction valve assembly 50C will temporarily flex or bow to open and allow the refrigerant to enter the high stage cylinder 46C through the high stage suction ports 86. The temporary bowing or flexing of the suction valve assemblies 50A, 50B, and 50C begins and ends at a different moment in time for each the suction valve assembly. Because the high stage piston 44C is substantially 120 degrees of crankshaft rotation apart from the center low stage piston 44A and 44B, the suction valve assemblies 50B and 50C will be open simultaneously together for about 60 degrees of crankshaft rotation before one suction valve assembly closes. Because of the substantially 120 degrees of crankshaft offset between the pistons 44A, 44B and 44C, all three suction valve assemblies 50A, 50B, and 50C will not be open simultaneously for any extended period of time.

The high stage piston 44C commences with a compression stroke when the high stage piston 44C begins outward movement in the high stage cylinder 46C. The compression stroke of the high stage piston 44C further compresses the refrigerant received in the high stage cylinder 46C during the suction stroke to an even higher temperature and pressure. The suction valve assembly 50C above returns to the closed position covering each high stage suction passageway 86 during the compression and discharge stroke of the high stage piston 44C. The refrigerant, now compressed to an even higher temperature and pressure, begins to discharge from the high stage cylinder 46C through the corresponding high stage discharge port 88 at a different moment in time from when the refrigerant begins to discharge from the low stage cylinders 46A and 46B.

More specifically, the pressure differential across the flapper component 94 (caused by the compression of the refrigerant by the low and high stage pistons 44A-44C) of each of the discharge valve assemblies 54A, 54B, and 54C becomes sufficient to open the flapper component 94 and allow for refrigerant passage at different moment in time for each discharge valve assembly. The discharge valve assembly 54C will be open simultaneously with the discharge valve assembly 54B above the center low stage cylinder 46B for about 60 degrees of crankshaft rotation before the discharge valve assembly 54B closes.

Simultaneous with the opening of the discharge valve assembly 54C, the refrigerant (which had been impinged in the high stage discharge port 88 by the discharge valve assembly 54C) is discharged into the upper portion high stage plenum 72 defined by the valve plate 20 and the interior and exterior walls 74, 76 of the cylinder head 22. From the upper portion of the high stage plenum 72 the refrigerant discharges through the high stage outlet port 34 (which is in fluid communication with the high stage plenum 72) to the other components in the heating or cooling system.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A multi-stage reciprocating compressor, comprising:

a working fluid inlet port;

a working fluid reservoir disposed in a crank case of the reciprocating compressor in fluid communication with the working fluid inlet port for housing of low pressure working fluid drawn into the reciprocating compressor, the crank case further including a crank shaft, the crank shaft is located in the working fluid reservoir;

a cylinder block defining at least two low stage cylinder and a high stage cylinder, each of the low stage cylinders having a low stage piston disposed therein and operably connected to the crank shaft, the high stage cylinder having a high stage piston disposed therein and operably connected to the crank shaft;

a cylinder head secured to the cylinder block overlying the low and high stage cylinders, the cylinder head defining an upper mid-stage plenum fully enclosed by a side wall of the cylinder head in fluid communication with the low stage cylinders and the high stage cylinder for communicating a working fluid discharged from the low stage cylinder to the high stage cylinder; and a valve plate disposed between the cylinder block and cylinder head;

the cylinder block defining a lower mid-stage plenum in fluid communication with the upper mid-stage plenum defined by the cylinder head via a valve plate port;

the cylinder block and the cylinder head together defining a low stage plenum in fluid communication with the working fluid reservoir, the working fluid drawn from the working fluid reservoir and into the low stage plenum and from the low stage plenum through the valve plate into the low stage cylinders during a suction stroke of the low stage pistons;

the working fluid remaining in the compressor when flowing from the low stage cylinders into the high stage cylinder, a discharge port of each of the low stage cylinders and a suction port of the high stage cylinder disposed on a same lateral side of a plane defined by and axis of symmetry of the valve plate and a rotational axis of the crank shaft.

2. The multi-stage compressor of claim 1, wherein a suction port of the low stage cylinder and a discharge port of the high stage cylinder are disposed on a same side of an axis extending through a center of each of the low and high stage cylinders.

3. The multi-stage compressor of claim 1, further comprising a discharge valve disposed within the mid-stage plenum for selectively impinging fluid communication from the low stage cylinder.

4. The multi-stage compressor of claim 1, wherein the cylinder block defines a second low stage cylinder in fluid communication with the mid-stage plenum.

5. The multi-stage compressor of claim 1, wherein a discharge port of the low stage cylinder and a suction port of the high stage cylinder extend through the valve plate and are disposed on a same side of an axis of symmetry of the valve plate.

6. The multi-stage compressor of claim 1, wherein a suction port of the low stage cylinder and a discharge port of the high stage cylinder extend through the valve plate and are disposed on a same side of an axis of symmetry of the valve plate.

7. The multi-stage compressor of claim 1, wherein a discharge port of the low stage cylinder and a discharge port of the high stage cylinder have a minor symmetry with respect to an axis extending through a center of each of the low and high stage cylinders such that one of the discharge ports is disposed on one side of the axis and the other discharge port is disposed on an opposite side of the axis.

8. A multi-stage reciprocating compressor, comprising:

a working fluid inlet port;

a working fluid reservoir disposed in a crank case of the reciprocating compressor in fluid communication with the working fluid inlet port for housing of low pressure working fluid drawn into the reciprocating compressor, the crank case further including a crank shaft, the crank shaft is located in the working fluid reservoir;

a cylinder block defining at least two low stage cylinders and a high stage Cylinder, each of the low stage cylinders having a low stage piston disposed therein and operably connected to the crank shaft, the high stage cylinder having a high stage piston disposed therein and operably connected to the crank shaft;

a cylinder head secured to the cylinder block overlying the low and high stage cylinders and defining a mid-stage plenum; and a valve plate disposed between the cylinder head and the cylinder block and defining a discharge port of each the low stage cylinders and a suction port of the high stage cylinder therethrough, the discharge port of the low stage cylinders and the suction port of the high stage cylinder allow a working fluid discharged from the low stage cylinders to be communicated through the upper mid-stage plenum fully enclosed by a side wall of the cylinder head to the high stage cylinder;

the cylinder block defining a lower mid-stage plenum in fluid communication with the upper mid-stage plenum defined by the cylinder head via a valve plate port;

the cylinder block and the cylinder head together defining a low stage plenum in fluid communication with the working fluid reservoir, the working fluid drawn from the working fluid reservoir and into the low stage plenum and from the low stage plenum through the valve plate into the low stage cylinders during a suction stroke of the low stage pistons;

the working fluid remaining in the compressor when flowing from the low stage cylinders into the high stage cylinder, the discharge ports of each of the at least two low stage cylinders and a suction port of the high stage cylinder disposed on a same lateral side of a plane defined by and axis of symmetry of the valve plate and a rotational axis of the crank shaft.

9. The multi-stage compressor of claim 8, wherein a suction port of the low stage cylinder and a discharge port of the high stage cylinder are generally aligned on a same side of an axis extending through a center of each of the low and high stage cylinders.

10. The multi-stage compressor of claim 8, further comprising a discharge valve disposed within the upper mid-stage plenum for selectively impinging fluid communication from the low stage cylinder.

11. The multi-stage compressor of claim 8, wherein the cylinder block defines a second low stage cylinder in fluid communication with the mid-stage plenum through a second discharge port in the valve plate.

12. The multi-stage compressor of claim 8, wherein the discharge port of the low stage cylinder and a discharge port of the high stage cylinder have a minor symmetry with respect to an axis extending through a center of each of the low and high stage cylinders such that one of the discharge ports is disposed on one side of the axis and the other discharge port is disposed on an opposite side of the axis.

13. The multi-stage compressor of claim 8, wherein the discharge port of the low stage cylinder and the suction port of the high stage cylinder are disposed on a same side of an axis of symmetry of the valve plate.

14. A multi-stage reciprocating compressor, comprising:

a working fluid inlet port;

a working fluid reservoir disposed in a crank case of the reciprocating compressor in fluid communication with the working fluid inlet port for housing of low pressure working fluid drawn into the reciprocating compressor, the crank case further including a crank shaft, the crank shaft is located in the working fluid reservoir;

a cylinder block defining at least two low stage cylinders and a high stage cylinder, each of the low stage cylinders having a low stage piston disposed therein and operably connected to the crank shaft, the high stage cylinder having a high stage piston disposed therein and operably connected to the crank shaft;

a cylinder head secured to the cylinder block overlying the low and high stage cylinders, the cylinder head defining an upper mid-stage plenum fully enclosed by a side wall of the cylinder head in fluid communication with the low stage cylinders and the high stage cylinder through a discharge port of each of the low stage cylinders and a suction port of the high stage cylinder; and a valve plate disposed between the cylinder block and cylinder head;

the cylinder block defining a lower mid-stage plenum in fluid communication with the upper mid-stage plenum defined by the cylinder head;

the cylinder block and the cylinder head together defining a low stage plenum in fluid communication with the working fluid reservoir, the working fluid drawn from the working fluid reservoir and into the low stage plenum and from the low stage plenum through the valve plate into the low stage cylinders during a suction stroke of the low stage pistons;

the working fluid remaining in the compressor when flowing from the low stage cylinders into the high stage cylinder;

each of the discharge ports and the suction port disposed on a same lateral side of a plane defined by an axis of symmetry of the valve plate and a rotational axis of the crank shaft.

15. The multi-stage compressor of claim 14, wherein the discharge port of the low stage cylinder and a discharge port of the high stage cylinder have a minor symmetry with respect to the axis extending through the center of each of the low and high stage cylinders such that one of the discharge ports is disposed on one side of the axis and the other discharge port is disposed on an opposite side of the axis.

* * * * *